US008839870B2

(12) United States Patent
Ring

(10) Patent No.: US 8,839,870 B2
(45) **Date of Patent: *Sep. 23, 2014**

(54) APPARATUS AND METHODS FOR RUNNING LINERS IN EXTENDED REACH WELLS

(75) Inventor: Lev Ring, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 777 days.

This patent is subject to a terminal disclaimer.

(21) Appl. No.: 12/750,362

(22) Filed: Mar. 30, 2010

(65) Prior Publication Data

US 2010/0243277 A1 Sep. 30, 2010

Related U.S. Application Data

(63) Continuation-in-part of application No. 12/206,544, filed on Sep. 8, 2008, now Pat. No. 7,699,113.

(60) Provisional application No. 61/315,286, filed on Mar. 18, 2010, provisional application No. 60/973,438, filed on Sep. 18, 2007.

(51) Int. Cl.

| | |
|---|---|
| ***E21B 23/00*** | (2006.01) |
| ***E21B 33/126*** | (2006.01) |
| ***E21B 43/10*** | (2006.01) |
| ***E21B 34/14*** | (2006.01) |

(52) U.S. Cl.

CPC ..... *E21B 33/126* (2013.01); *E21B 43/105* (2013.01); *E21B 34/14* (2013.01)

USPC ..... 166/382; 166/383; 166/207; 166/50

(58) Field of Classification Search

USPC ..... 166/206–208, 212, 383, 50, 380, 382; 294/86.15, 86.24

See application file for complete search history.

(56) References Cited

U.S. PATENT DOCUMENTS

| | | | | |
|---|---|---|---|---|
| 2,546,978 | A * | 4/1951 | Collins et al. | 166/290 |
| 4,898,243 | A | 2/1990 | Lindsey et al. | |
| 5,234,055 | A | 8/1993 | Cornette | |
| 5,566,772 | A | 10/1996 | Coone et al. | |
| 5,884,702 | A | 3/1999 | Yokley et al. | |

(Continued)

FOREIGN PATENT DOCUMENTS

| | | |
|---|---|---|
| EP | 1026365 A2 | 8/2000 |
| EP | 1184536 A2 | 3/2002 |

(Continued)

OTHER PUBLICATIONS

GCC Examination Report dated Sep. 12, 2011, Application No. GCC/P/2008/11726.

(Continued)

*Primary Examiner* — Yong-Suk (Philip) Ro

(74) *Attorney, Agent, or Firm* — Patterson & Sheridan, LLP

(57) ABSTRACT

A method of lining a wellbore includes deploying the liner into the wellbore using a workstring and a setting tool. The method further includes engaging the setting tool with a casing or liner previously installed in the wellbore. The method further includes pressurizing a chamber formed between a seal of the setting tool and a shoe of the liner, thereby driving the liner further into the wellbore, wherein reactionary force is transferred to the previously installed casing or liner by the engaged setting tool.

17 Claims, 17 Drawing Sheets

(56) References Cited

U.S. PATENT DOCUMENTS

| | | | | |
|---|---|---|---|---|
| 6,085,838 | A | 7/2000 | Vercaemer et al. | |
| 6,481,500 | B1 | 11/2002 | Burd et al. | |
| 6,497,289 | B1 | 12/2002 | Cook et al. | |
| 6,520,257 | B2 | 2/2003 | Allamon et al. | |
| 6,899,186 | B2 | 5/2005 | Galloway et al. | |
| 6,920,932 | B2 | 7/2005 | Zimmerman | |
| 7,373,988 | B2 | 5/2008 | Campbell et al. | |
| 7,699,113 | B2 * | 4/2010 | Ring | 166/382 |
| 7,753,130 | B2 | 7/2010 | Cote | |
| 2003/0196818 | A1 | 10/2003 | Lynde et al. | |
| 2004/0055786 | A1 | 3/2004 | Maguire et al. | |
| 2004/0206512 | A1 | 10/2004 | Baugh | |
| 2006/0048939 | A1 | 3/2006 | Johnson | |
| 2006/0185855 | A1 | 8/2006 | Jordan et al. | |
| 2007/0000664 | A1 | 1/2007 | Ring et al. | |
| 2007/0023192 | A1 | 2/2007 | Cote | |
| 2007/0107941 | A1 | 5/2007 | Fillipov et al. | |
| 2009/0272544 | A1 | 11/2009 | Giroux et al. | |

FOREIGN PATENT DOCUMENTS

| | | | |
|---|---|---|---|
| EP | 2039879 | A2 | 3/2009 |
| GB | 2 399 580 | | 9/2004 |
| GB | 2 412 394 | | 9/2005 |
| GB | 2 435 280 | | 8/2007 |
| WO | 97/49894 | | 12/1997 |
| WO | WO 02/097234 | | 12/2002 |
| WO | 03/104611 | | 12/2003 |
| WO | WO 2004/027205 | | 4/2004 |
| WO | WO 2004/031527 | | 4/2004 |

OTHER PUBLICATIONS

EP Search Report for Application No. 08164568.1-1266 / 2039879 dated Mar. 16, 2011.

Australian Examination Report for Application No. 2008212066 dated Feb. 2, 2011.

Australian Examination Report for Application No. 2008212066 dated Feb. 9, 2010.

Canadian Office Action for Application No. 2,639,426 dated Apr. 26, 2010.

EP Partial Search Report for Application No. 08164568 dated Oct. 1, 2010.

Moore, et al., A Method for Isolating Pressure-Depleted Zones With Solid Expandable Tubulars, SPE-81095, paper prepared for presentation at the SPE Latin American and Caribbean Petroleum Engineering Conference held in Port-of-Spain, Trinidad, West Indies, Apr. 27-30, 2003, pp. 1-8.

Moore, et al., A Method for Isolating Pressure-Depleted Zones with Solid-Expandable Tubulars, SPE Drilling & Completion Journal, Dec. 2004, pp. 244-248.

EPO Extended European Search Report dated Nov. 22, 2013, in European Application No. 11158537.8.

Australian Patent Examination Report No. 1 dated Feb. 11, 2014, for Australian Patent Application No. 2011201149.

Australian Patent Examination Report No. 2 dated Feb. 20, 2014, for Australian Patent Application No. 2011201149.

* cited by examiner

APPARATUS AND METHODS FOR RUNNING LINERS IN EXTENDED REACH WELLS

CROSS-REFERENCE TO RELATED APPLICATIONS

This application claims benefit of U.S. Prov. Pat. App. 61/315,286, filed Mar. 18, 2010.

This application is a continuation-in-part of U.S. patent application Ser. No. 12/206,544, filed Sep. 8, 2008 now U.S. Pat. No. 7,699,113, which claims benefit of U.S. Prov. Pat. App. 60/973,438, filed on Sep. 18, 2007, both of which are herein incorporated by reference in their entireties.

BACKGROUND OF THE INVENTION

1. Field of the Invention

The present invention generally relates to completion operations in a wellbore. More particularly, the invention relates to running liners in extended reach wells.

2. Description of the Related Art

In extended reach wells or wells with complex trajectory, operators often experience difficulty in running a liner/casing past a certain depth or reach. The depth or reach of the liner is typically limited by the drag forces exerted on the liner. If further downward force is applied, the liner may be pushed into the sidewall of the wellbore and become stuck or threaded connections in the liner may be negatively impacted. As a result, the liners are prematurely set in the wellbore, thereby causing hole downsizing.

Various methods have been developed to improve liner running abilities. For example, special low friction centralizers or special fluid additives may be used to reduce effective friction coefficient. In another example, floating a liner against the wellbore may be used to increase buoyancy of the liner, thereby reducing contact forces.

There is a need, therefore, for apparatus and methods to improve tubular running operations.

SUMMARY OF THE INVENTION

In one embodiment, a method of lining a wellbore includes deploying the liner into the wellbore using a workstring and a setting tool; engaging the setting tool with a casing or liner previously installed in the wellbore; and pressurizing a chamber formed between a seal of the setting tool and a shoe of the liner, thereby driving the liner further into the wellbore, wherein reactionary force is transferred to the previously installed casing or liner by the engaged setting tool.

In another embodiment, a method of lining a wellbore includes deploying the liner into the wellbore using a workstring and a setting tool; engaging the setting tool with a casing or liner previously installed in the wellbore; and pressurizing the setting tool, thereby engaging a piston with an inner surface of the liner and driving the piston and liner further into the wellbore, wherein reactionary force is transferred to the previously installed casing or liner by the engaged setting tool.

In another embodiment, a method of running a liner into a wellbore includes securing an inner string to the liner, wherein the inner string comprises a seal operable to engage an interior of the liner; running the liner into the wellbore using the inner string; releasing the liner from the inner string; closing a valve disposed in a shoe of the liner; and pressurizing an internal area between the seal and the valve, thereby advancing the liner further into the wellbore.

In another embodiment, a method of running a liner into a wellbore includes securing an inner string to a liner assembly, the liner assembly comprising an outer liner and an inner liner disposed within the outer liner; running the liner assembly into the wellbore using the inner string; and extending the inner liner from the outer liner into the wellbore using the inner string.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 11A illustrates deployment of the liner assembly. FIG. 11B illustrates release of the latch and setting of the anchor. FIG. 11C illustrates driving the liner into a deviated, such as horizontal, section of the wellbore. FIG. 11D illustrates rupture of the isolation valve. FIG. 11E illustrates pumping cement through the setting tool. FIG. 11F illustrates the liner assembly cemented to the wellbore 150. FIG. 11G illustrates the liner hanger expanded into engagement with the casing and the setting tool being retrieved to surface.

DETAILED DESCRIPTION

In one embodiment, a liner 100 is assembled conventionally on a rig floor. The liner 100 is suspended from the rig floor and held in place using slips, such as from a spider or a rotary table. A false rotary table may be mounted above the slips holding the liner 100. Then, an inner string 120 is run into the liner 100, as shown in FIGS. 1A and 1B.

Figure 1A:
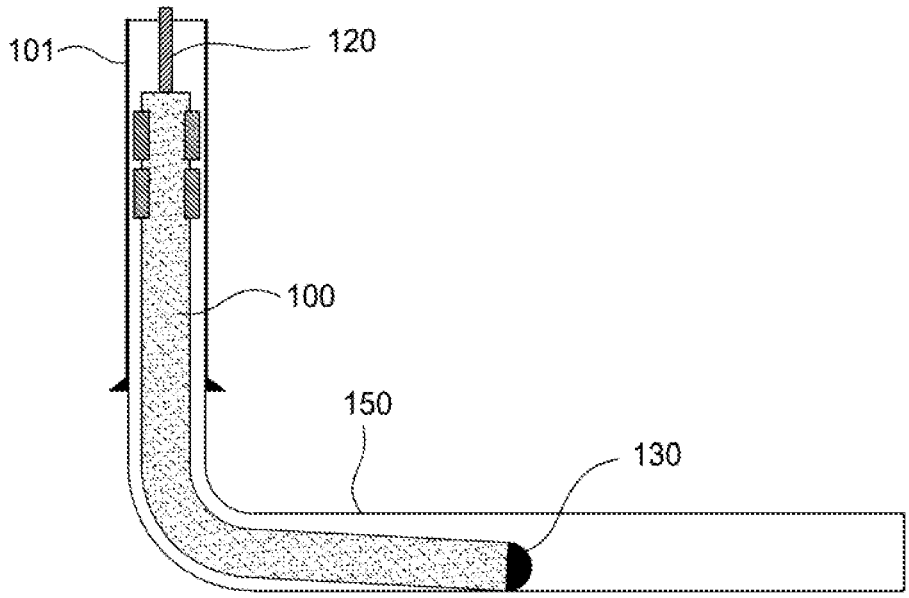
FIGS. 1A and 1B are views of a liner equipped with an inner string having a piston device. The liner is located at a first position in a wellbore.
Figure 1B:
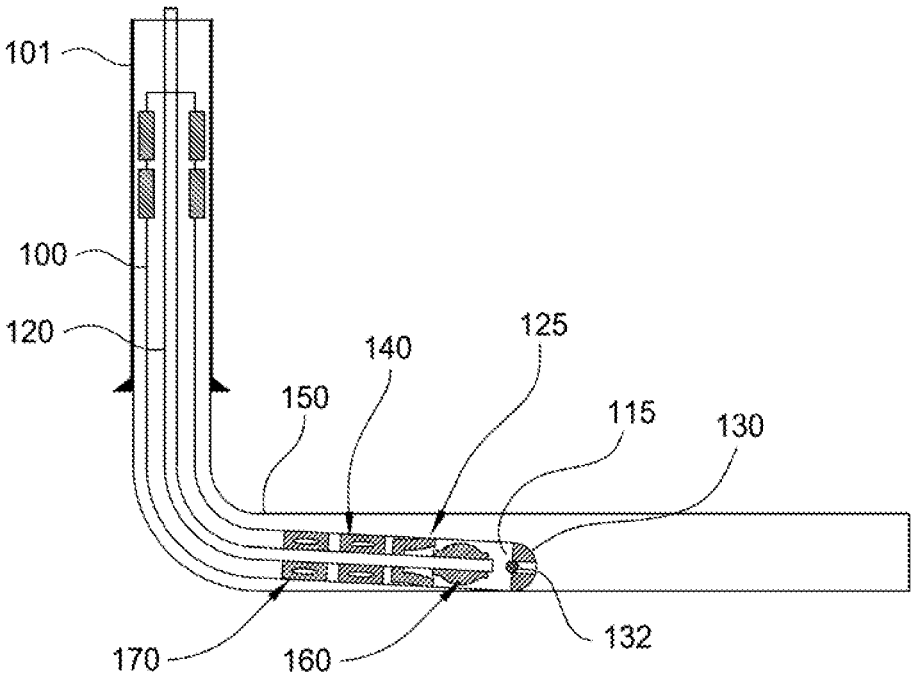

FIG. 1A is an external view of the liner 100, and FIG. 1B is an internal view of the liner 100. The liner 100 may include a casing shoe 130 disposed at an end thereof. A lower portion of the inner string 120 may include a device, such as a seal cup 125, to allow pressurizing the internal area 115 of the liner 100 between the shoe 130 and the seal cup 125. In one embodiment, the inner string 120 may include a piston assembly instead of or in addition to the seal cup 125. The inner string 120 may also include an anchoring or latching device 140 to prevent relative axial movement between liner 100 and the inner string 120. In one embodiment, the inner string 120 may be a drill pipe. The inner string 120 may also include an expansion tool 160, such as a rotary expander, a compliant expander, and/or a fixed cone expander, to expand at least a portion of the liner 100.

The inner string 120 may be run all the way to the shoe 130 or to any depth within the liner 100. After the inner string is located in the liner 100, the anchoring device 140 may be actuated to secure the inner string 120 to the liner 100. After the inner string 120 is assembled, the liner 100 is released from the rig floor and is run into the wellbore 150 to a particular depth. The depth to which the liner 100 is run may be limited by torque or drag forces, as illustrated in FIG. 1A. In one embodiment, a ball 132 or dart is dropped to close a circulation valve at the shoe 130. In another embodiment, circulation may also be closed using a control mechanism, such as a velocity valve or another closure device known to a person of ordinary skill. When the released ball 132 passes by the anchor device 140, the ball 132 may de-actuate the anchor device 140 to release the liner 100 from the inner string 120. After the ball 132 closes circulation, pressure is supplied to increase the pressure in the internal area 115 between the seal cup 125 and the shoe 130. The pressure increase exerts an active liner pushing force against the shoe 130, thereby causing the liner 100 to travel down further into the wellbore 150. In this respect, the active liner pushing force is equal to the pumping pressure multiplied by the piston area within the liner 100. The internal pressurization of the liner 100 may help alleviate a tendency of the liner 100 to buckle as it travels further into the wellbore 150. In one embodiment, the active liner pushing force is provided in a direction that is similar or parallel to the direction of the wellbore 150. In this respect, the effect of the drag forces is reduced to facilitate movement of the liner 100 within the wellbore 150.

After the liner 100 has been extended into the wellbore 150, the pressure in the internal area 115 may be released. The inner string 120 may then be lowered and/or relocated in the liner 100, thereby repositioning the seal cup 125. The tools, such as the seal cups 125, may be positioned at the top or at any location within the liner 100. The seal cups 125 may be stroked within the liner 100 numerous times. The pressure may again be supplied to the internal area 115 to facilitate further movement of the liner 100 within the wellbore 150. This process may be repeated multiple times by releasing the pressure in the liner 100 and re-locating the inner string 120.

In one embodiment, a hydraulic slip 170, or other similar anchoring device, may be coupled to the liner 100 and/or the inner string 120 to resist any reactive force provided on the string or the liner that will push the string or liner in an upward direction or in any direction toward the well surface. The hydraulic slip 170 may be operable to prevent the inner string 120 from being pumped back to the surface, while forcing the liner 100 into the wellbore 150. In one embodiment, the hydraulic slip 170 may be coupled to the interior of the liner 100 to engage the inner string 120. In one embodiment, the hydraulic slip 170 may be coupled to the inner string 120 to engage the liner 100. In one embodiment, the hydraulic slip 170 may be coupled to the exterior of the liner 100 to engage the wellbore 150.

Figure 2A:
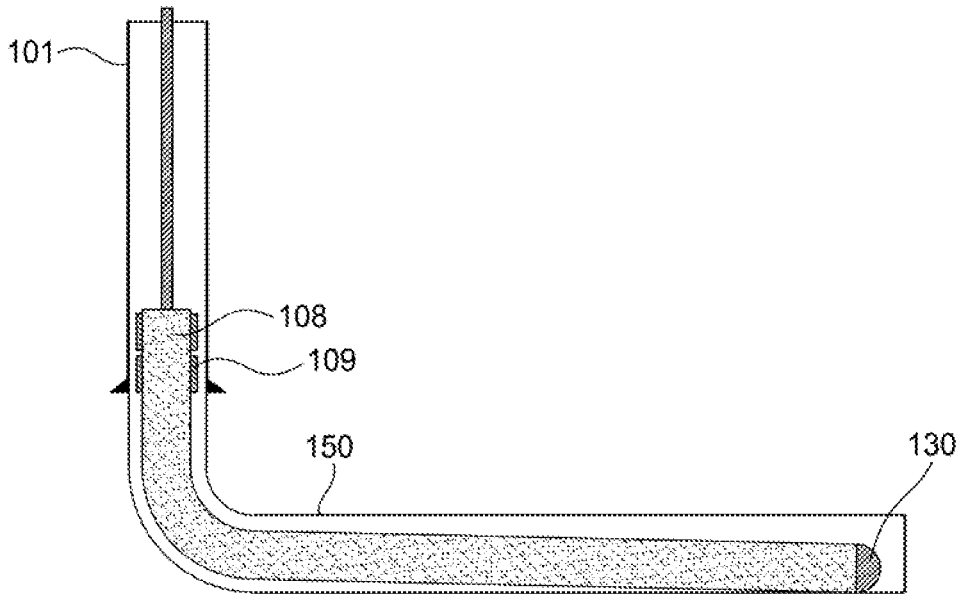
FIGS. 2A and 2B are views of the liner in a second location in the wellbore, the liner being moved by actuation of the piston device.
Figure 2B:
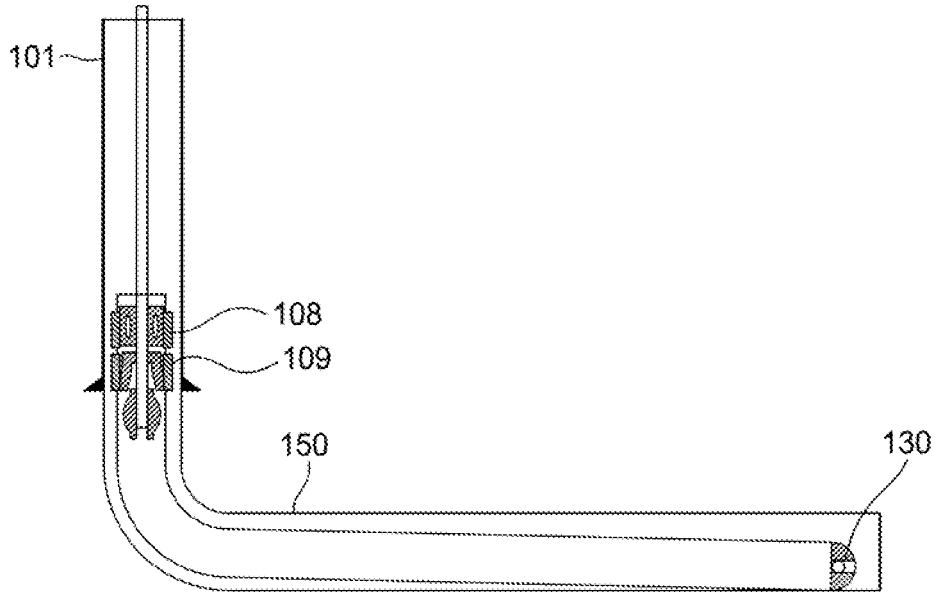

In another embodiment, the liner 100 may optionally include an expandable liner hanger 108, as shown in FIGS. 2A and 2B. As shown, the liner hanger 108 is equipped will a sealing member 109, such as an elastomer. FIG. 2A is an external view of the liner 100, and FIG. 2B is an internal view of the liner 100. When the inner string 120 is pulled all the way to the liner hanger 108, the expansion tool 160 may be activated. The expansion tool 160 may be activated from a (collapsed) travel position to a (enlarged) working position. The liner hanger 108 may be expanded using any tool and technique known in the art. Expansion of the liner hanger 108 anchors the liner 100 and seals the liner top. Alternatively, a conventional liner hanger may be used.

Figure 3:
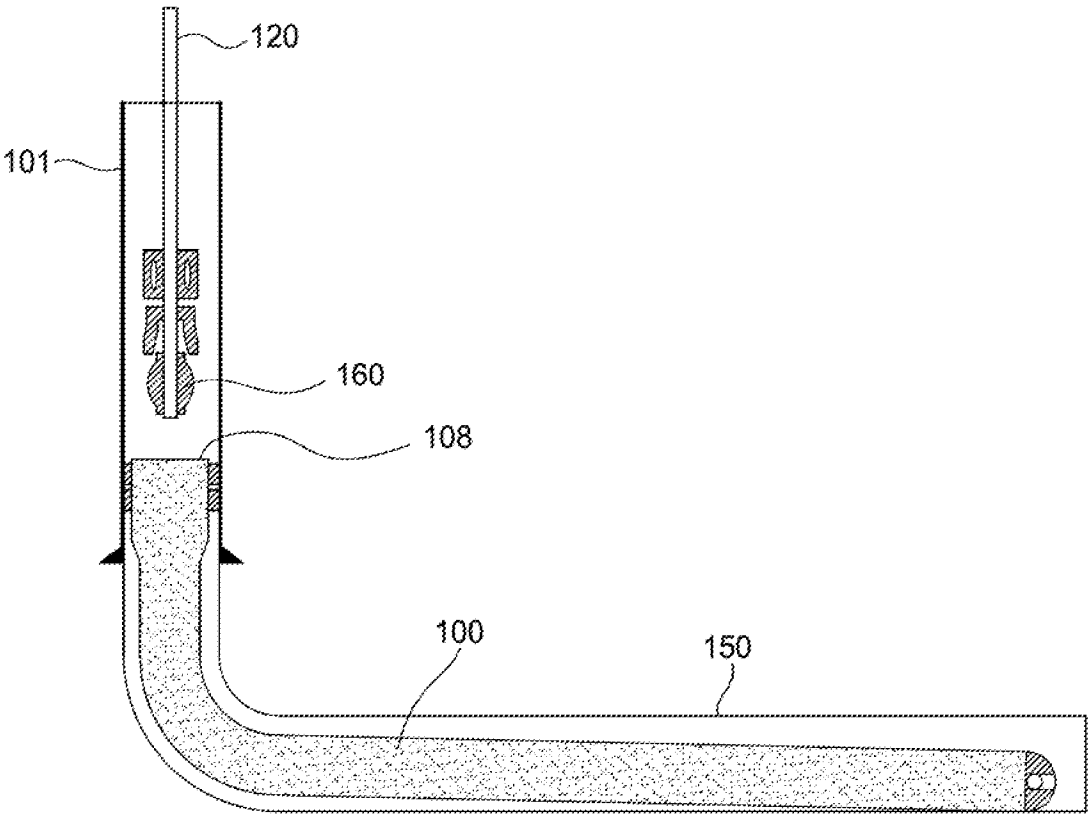
FIG. 3 shows the liner having an expandable liner hanger expanded against a casing.

FIG. 3 shows the liner hanger 108 expanded and set against casing 101. The inner string 120 may then be pulled out of the wellbore 150. In one embodiment, the liner 100 may be cemented in the wellbore 150. In one embodiment, the liner 100 may be radially expanded. In one embodiment, the liner 100 may be expanded at one or more discrete locations to effect zonal isolation or sand production control. In one embodiment, the liner 100 may include a sand control screen, such as an expandable screen.

Figure 4:
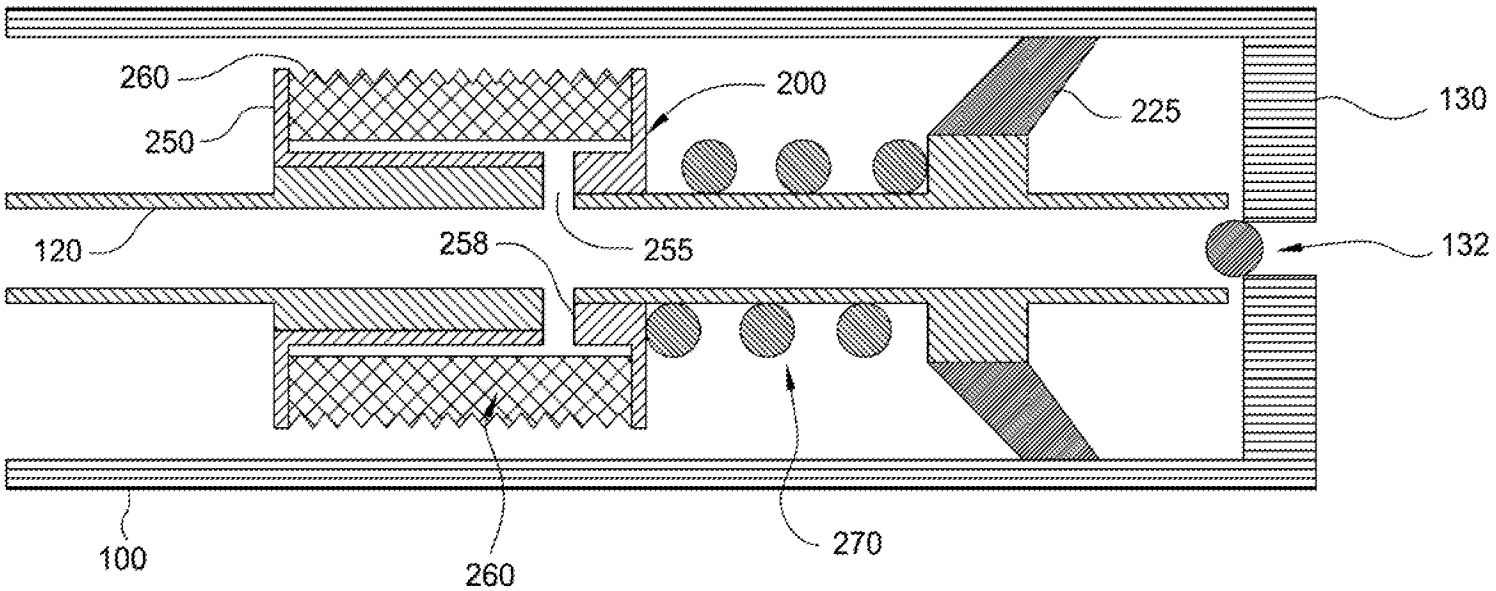
FIG. 4 shows an inner string equipped with another embodiment of the piston device. As shown, the piston device is in the unactuated position.

FIG. 4 shows one embodiment of the inner string 120 (also referred to as a "running tool") equipped with a jack piston device 200. The inner string 120 is shown disposed in a liner 100. The liner 100 is provided with a shoe 130. The inner string 120 includes a seal 225 for sealing against the liner 100. In one embodiment, the piston device 200 includes a housing 250 movably disposed on the exterior of the inner string 120. A port 255 is provided to allow fluid communication between the interior of the inner string 120 and the housing 250. Seals may be disposed between the piston device 200 and the inner string 120. A slip 260 is supported in the housing 250 and is radially movable in response to a pressure in the housing 250.

Figure 5:
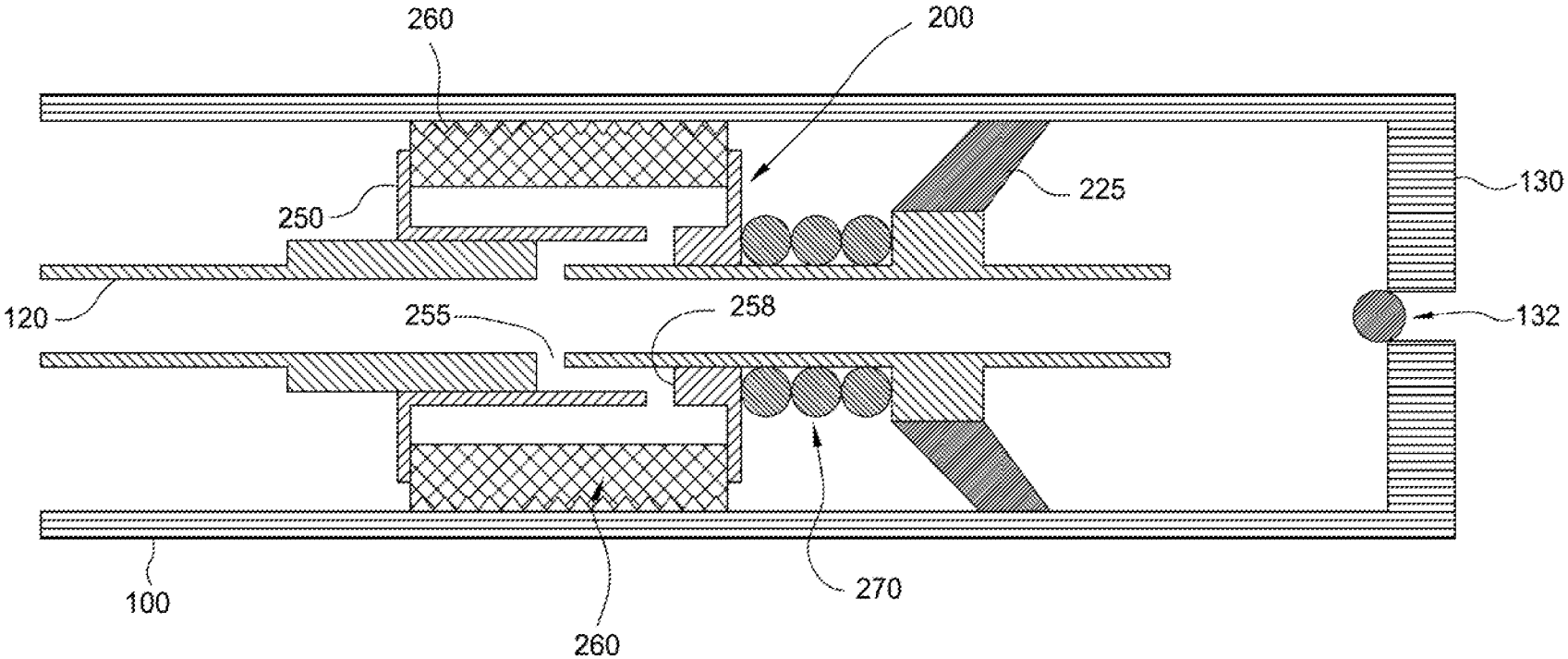
FIG. 5 shows the piston device of FIG. 4 in the actuated position.

In operation, the liner 100 and the inner string 120 may be lowered into the casing 101 to a depth at which further progress is impeded. A ball 132 is released into the liner 100 to seat in a valve in the shoe 130 to close fluid circulation. Pressure increase in the inner string 120 causes the slips 260 to move radially outward into engagement with the liner 100. Further pressure increase causes the piston device 200 to move relative to the inner string 120 and in the direction of the shoe 130. This movement is due to the fluid pressure acting on piston surface 258 provided in the housing 250. Because the piston device 200 is engaged to the liner 100 via the slips 260, the liner 100 is moved along with the piston device 200, thereby advancing the liner 100 further into the wellbore 150. In FIG. 5, it can be seen that the piston device 200 has moved closer to the seal 225 and that the liner 100 has traveled down. After the liner 100 has moved, the pressure in the inner string 120 may be reduced to retract the slips 260. Thereafter, the piston device 200 may be re-pressurized so that the process may be repeated to advance the liner 100 further into the wellbore 150. In one embodiment, the inner string 120 may be repositioned so that the process may be repeated to advance the liner 100 further into the wellbore 150. In one embodiment, the pressure contained by the seal 225 also acts on the liner shoe 130 so that the combination of this pressure plus the force exerted by the piston device 200 pushes the liner 100 further into the wellbore 150.

In one embodiment, a biasing member 270 may be provided to facilitate repositioning of the piston device 200 relative to the port 255. In one embodiment, the biasing member 270 may be a spring that is disposed between the seal 225 and the piston device 200, such that it engages a shoulder on the inner string 120 at one end and engages the housing 250 at the opposite end. As the piston device 200 is moved toward the seal 225, the spring is compressed, as shown in FIG. 5. After the pressure in the inner string 120 is reduced and the slips 260 are disengaged from the liner 100, the spring will exert a biasing force to move the piston device 200 to its original position relative to the port 255.

Figure 6:
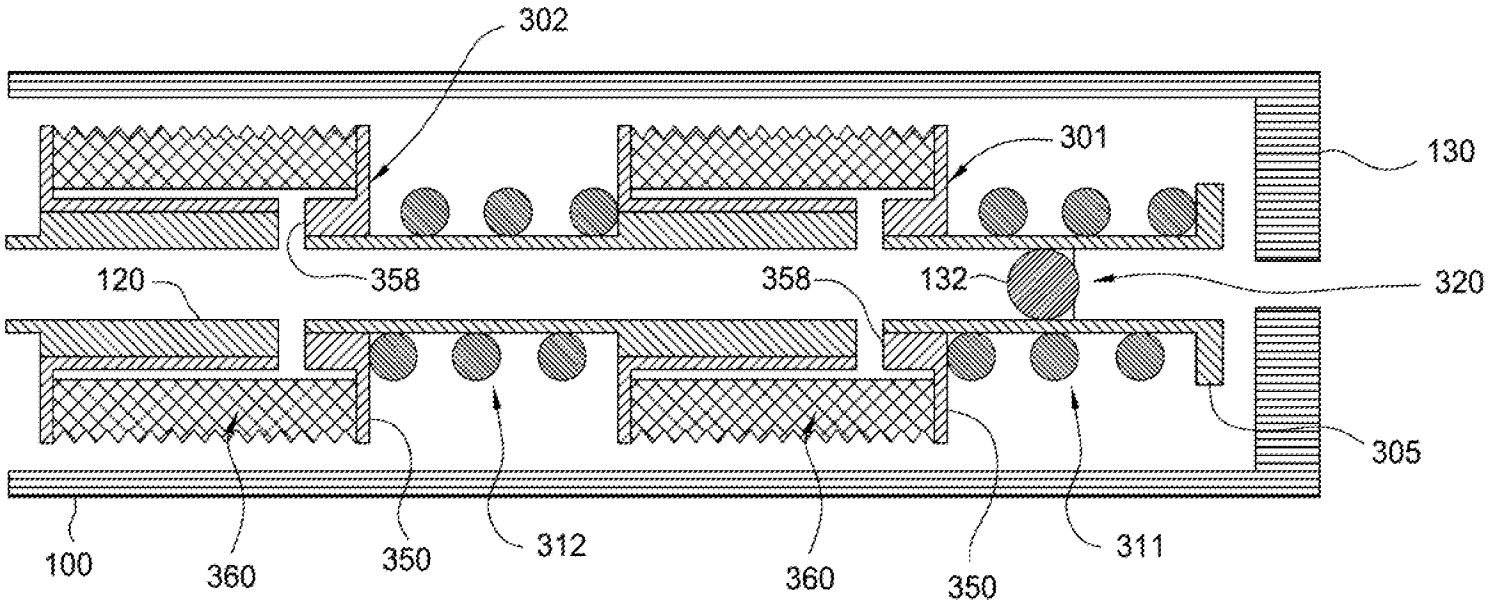
FIG. 6 shows an inner string equipped with yet another embodiment of the piston device. As shown, the piston device is in the unactuated position.

In one embodiment, a plurality of piston devices may be used on an inner string 120. FIG. 6 shows an inner string 120 with two piston devices 301 and 302. In one embodiment, a first biasing member 311 is disposed between a shoulder 305 on the inner string 120 and the first piston device 301, and a second biasing member 312 is disposed between the two piston devices 301 and 302. A landing seat 320 is provided in the inner string 120 to close circulation between the inner string 120 and the liner 100, and/or the inner string 120 and the wellbore 150. In one embodiment, the inner string 120 may be equipped with the seal configuration as shown in FIG. 1B or 4.

In operation, a ball 132 is released into the inner string 120 to seat in the landing seat 320 to close fluid circulation. Pressure increase in the inner string 120 causes the slips 360 to move radially outward into gripping engagement with the liner 100. Further pressure increase causes the piston devices 301 and 302 to move relative to the inner string 120 and in the direction of the shoe 130. This movement is due to the piston surfaces 358 provided in the housings 350 of the piston devices 301 and 302. Because the piston devices 301 and 302 are engaged to the liner 100 via the slips 360, the liner 100 is moved along with the piston devices 301 and 302, thereby advancing the liner 100 further into the wellbore 150.

Figure 7:
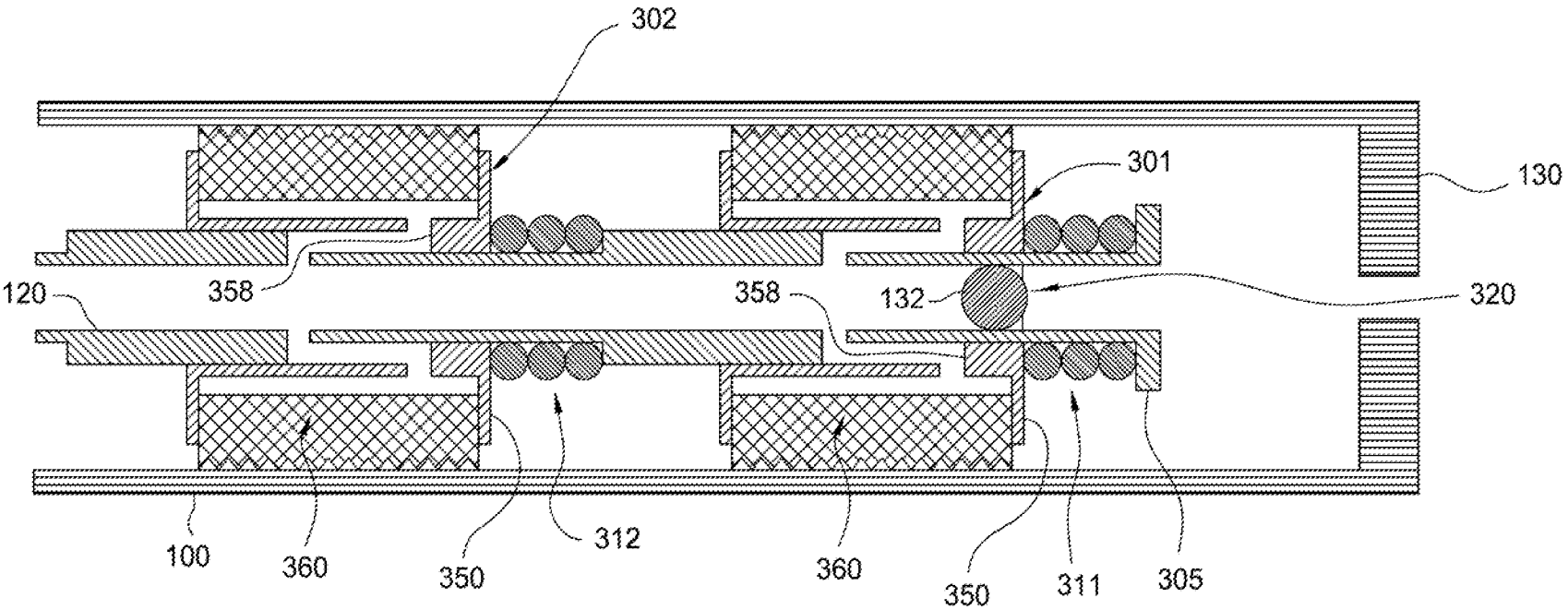
FIG. 7 shows the piston device of FIG. 6 in the actuated position.

In FIG. 7, it can be seen that the piston devices 301 and 302 have moved closer to the shoulder 305 and that the liner 100 has traveled down. After the liner 100 has moved, the pressure in the inner string 120 may be reduced to retract the slips 360. After the pressure is reduced, the biasing members 311 and 312 are operable to move the piston devices 301 and 302 back to their original position. Thereafter, the piston devices 301 and 302 may be re-pressurized so that the process may be repeated to advance the liner 100 further into the wellbore 150. In one embodiment, the inner string 120 may be repositioned so that the process may be repeated to advance the liner 100 further into the wellbore 150.

Figure 8:
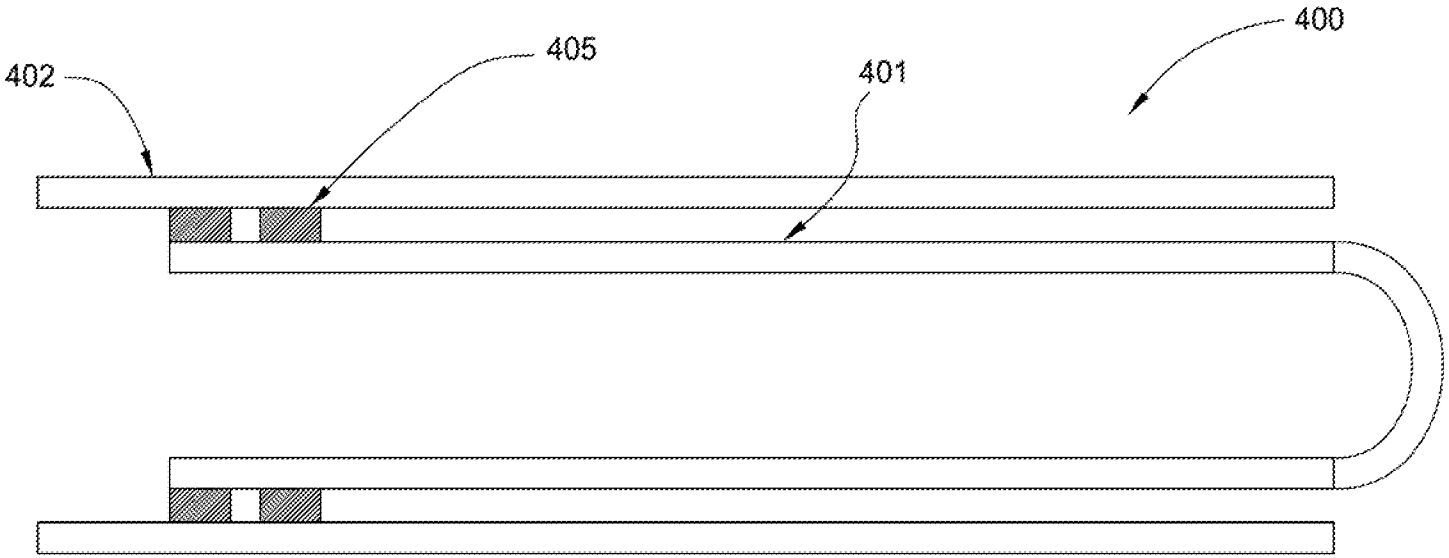
FIG. 8 shows a telescopic liner assembly.

In one embodiment, the inner string 120 may be used to extend a telescope liner assembly 400, as shown in FIG. 8. FIG. 8 shows the liner assembly 400 having an inner liner 401 at least partially disposed within an outer liner 402. One or more seals 405 may be disposed between the inner liner 401 and the outer liner 402. In one embodiment, the inner string 120 disposed in the liner assembly 400 is equipped with a seal piston configuration as shown in FIGS. 1B and/or 4.

Figure 9:
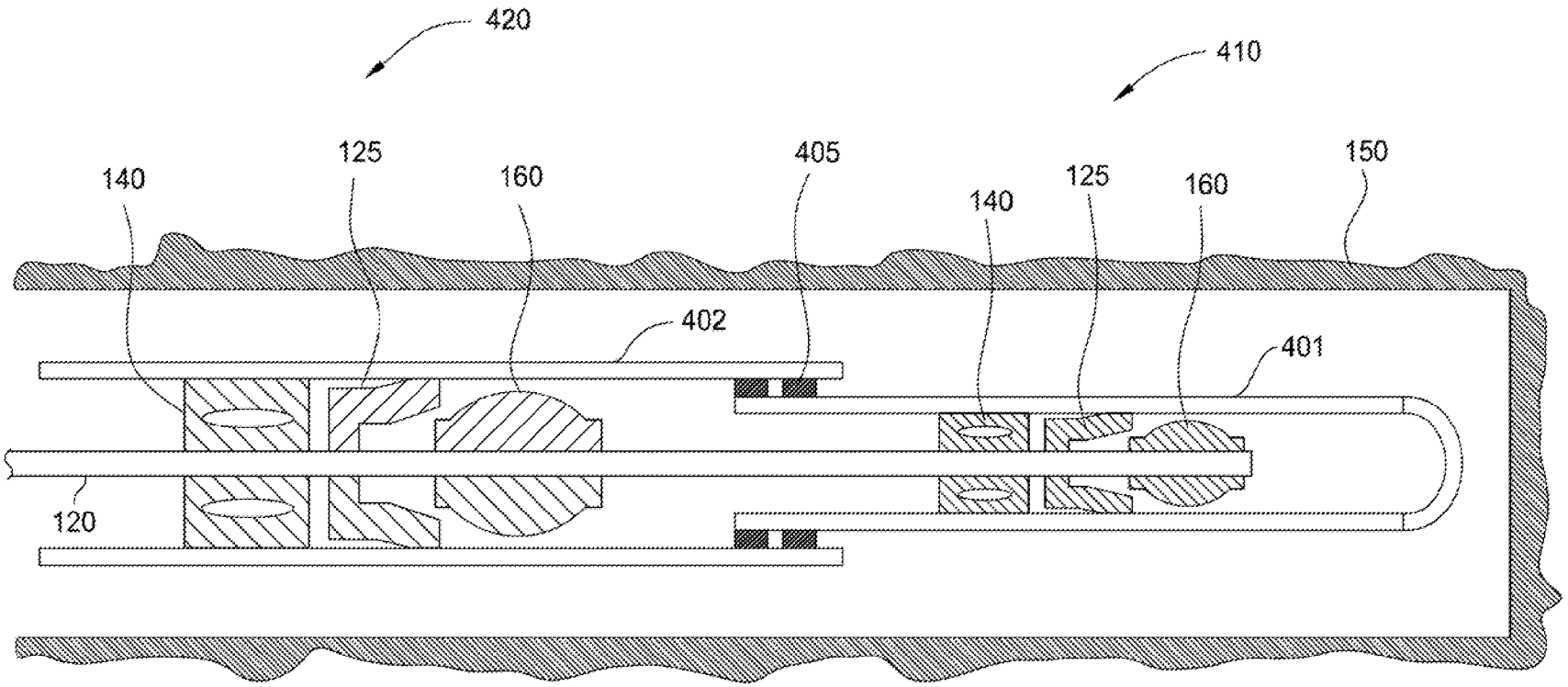
FIG. 9 shows the telescopic liner assembly extended using an embodiment of the piston device.

A seal piston 420 may be positioned in the liner assembly 400 such that the seal 125 is adapted to engage the outer liner 402, as shown in FIG. 9. The seal piston 420 may further include an anchoring device 140 and/or an expansion tool 160. In one embodiment, a seal piston 410 may be positioned in the inner liner 401 such that the seal 125 engages the inner liner 401. The seal piston 410 may further include an anchoring device 140 and/or an expansion tool 160. In one embodiment, the inner string 120 may include two seal pistons 410 and 420 with one located in each liner 401 and 402. In one embodiment, the inner string 120 may equipped with jack piston devices instead of the seal piston and/or both.

In operation, the inner string 120, having either seal piston 420 or 410, or both, may be introduced into the liner assembly 400 and secured in the liner assembly 400 via anchoring devices 140. The inner string 120 and the liner assembly 400 may be lowered into the wellbore 150 to a predetermined depth. As described above, a ball, a dart, or other triggering mechanism may be used to deactivate one or both of the anchoring devices 140 from engagement with the liner assembly 400. Pressure may then be supplied through the inner string 120, thereby pressurizing the liner assembly 400 against the seal pistons 420 and/or 410, and providing an active liner force to telescope the inner liner 401 into the wellbore 150 relative to the outer liner 402. Further pressurization may then allow the inner liner 401 and the outer liner 402 to advance further into the wellbore 150 relative to the inner string 120. The pressure may be released to allow relocation and/or removal of the inner string 120. This process may be repeated to even further advance the liner assembly 400 into the wellbore 150.

In one embodiment, the liner assembly 400 may be equipped with a locking mechanism such that after the inner liner 401 is extended, the piston devices 410 and/or 420 may be used to move the inner liner 401 and the outer liner 402.

In one embodiment, the inner liner 401 and the outer liner 402 may initially be releasably connected. During operation, the inner and outer liners 401 and 402 are moved along in the wellbore 150. At a predetermined depth, the releasable connection may be sheared or otherwise disconnected, thereby allowing the inner liner 401 to be extended relative to the outer liner 402.

Figure 10:
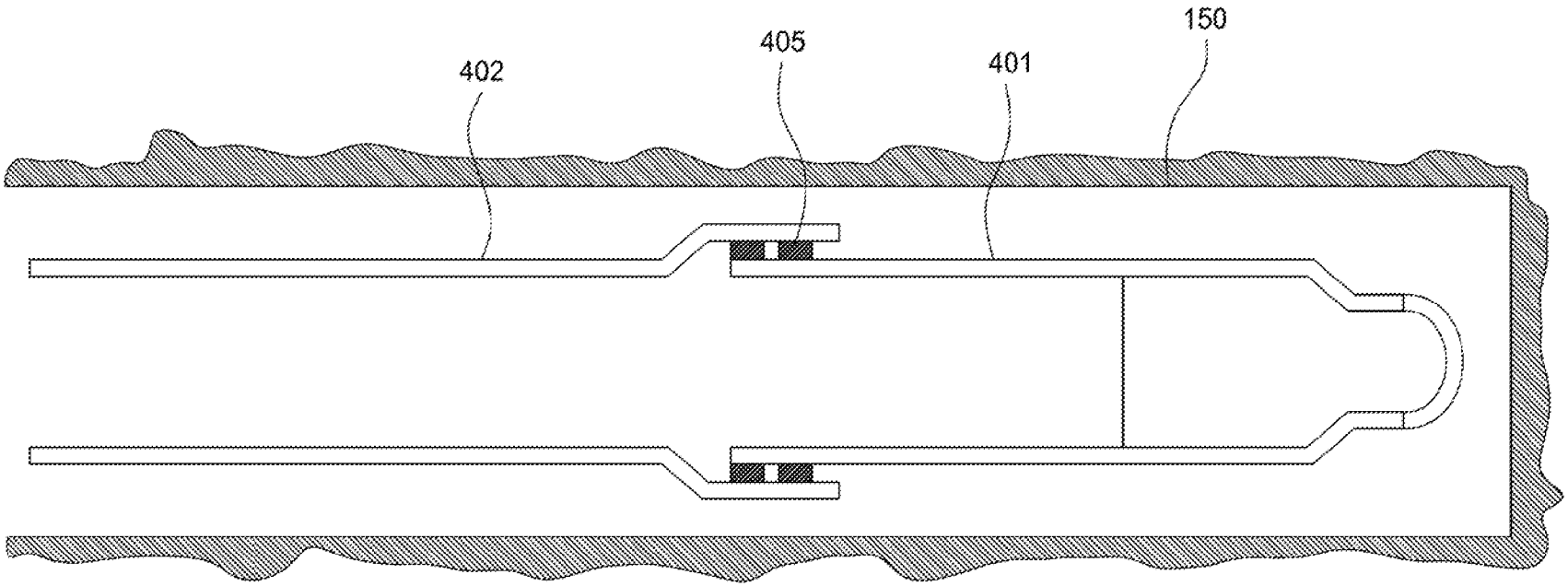
FIG. 10 shows expansion of the telescopic liner assembly after extension.

In one embodiment, after the inner liner 401 has been extended from the outer liner 402, the inner liner 401 may be optionally radially expanded, as shown in FIG. 10. In one embodiment, the outer liner 402 may also be radially expanded.

In further embodiments, the liner (any of 100, 400, 401, 402) may be equipped with a drilling or reaming device at or on the shoe, such that the borehole may be drilled or reamed during the running operation.

Figure 11A:
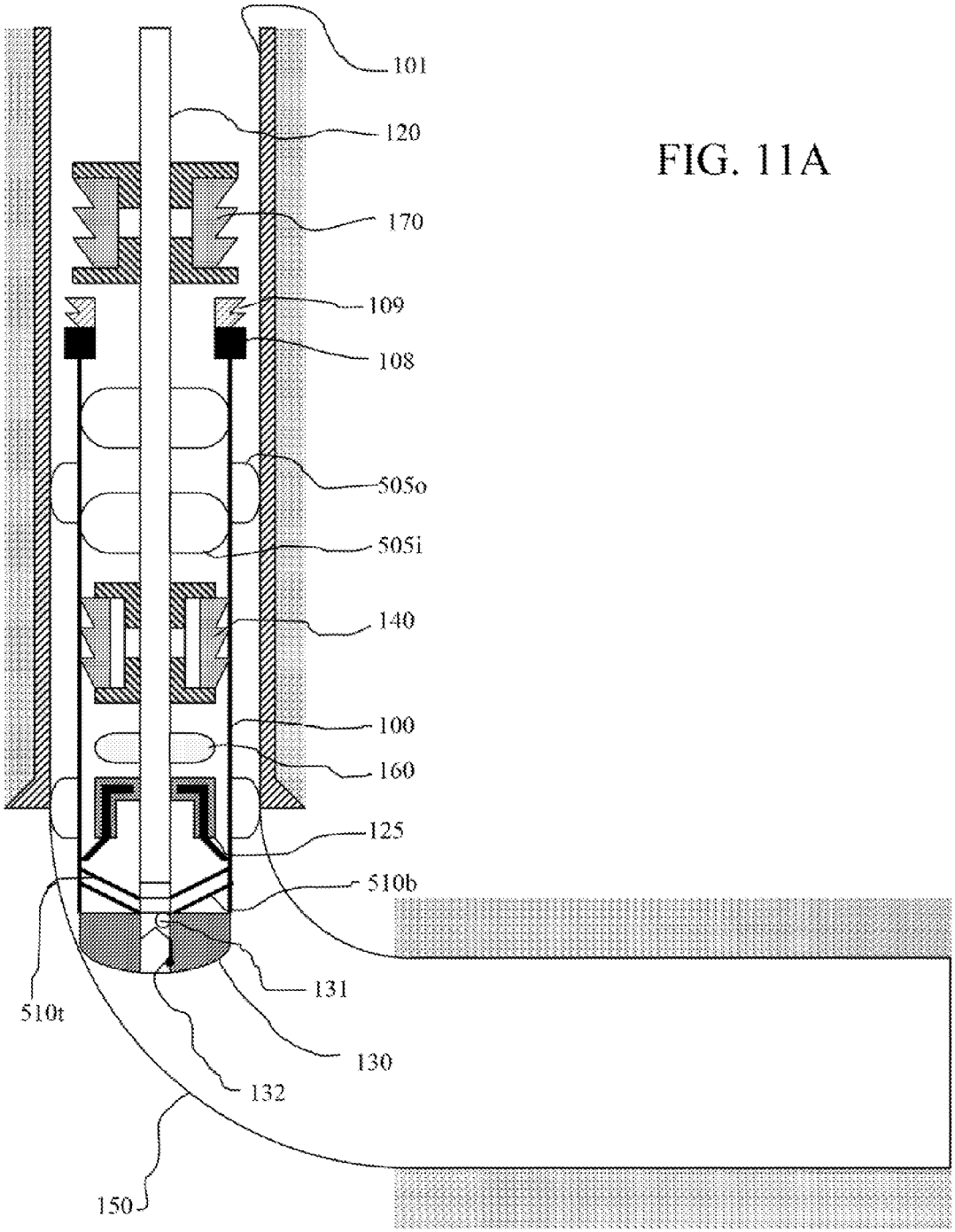
FIGS. 11A-G illustrate deployment and installation of a liner assembly, according to another embodiment of the present invention.

FIGS. 11A-G illustrate deployment and installation of a liner assembly, according to another embodiment of the present invention. FIG. 11A illustrates deployment of the liner assembly. A setting tool and liner assembly may be run into the wellbore 150 using a workstring 120. The setting tool and liner assembly may be lowered into the wellbore until progress is impeded by frictional engagement of the liner assembly with the wellbore. The liner assembly may include an expandable liner hanger 108, 109, a polished bore receptacle (PBR) (not shown), the shoe 130, one or more centralizers 5050, and the liner string 100. The liner 100 may be made from a metal or alloy, such as steel or stainless steel. Members of the liner assembly may each be longitudinally connected to one another, such as by a threaded connection.

The shoe 130 may be disposed at the lower end of the liner 100. The shoe 130 may be a tapered or bullet-shaped and may guide the liner 100 toward the center of the wellbore 150. The shoe 130 may minimize problems associated with hitting rock ledges or washouts in the wellbore 150 as the liner assembly 100 is lowered into the wellbore. An outer portion of the shoe 130 may be made from the liner material, discussed above. An inner portion of the shoe 130 may be made of a drillable material, such as cement, aluminum or thermoplastic, so that the inner portion may be drilled through if the wellbore 150 is to be further drilled.

A bore may be formed through the shoe 130. The shoe 130 may include a float valve 131 and isolation valve 132 for selectively sealing the shoe bore. The float valve 131 may be a check valve and may be held open during deployment by a stinger (not shown) extending from the setting tool. Once released from the stinger, the float valve 131 may allow fluid flow from the liner 100 into the wellbore 150 and prevent reverse flow from the wellbore into the liner. The float valve 131 may be held open during deployment to allow wellbore fluid displaced by deployment of the liner assembly to flow through the workstring 120 to the surface (in addition to flow through an annulus formed between the liner/workstring and the wellbore). Alternatively, the stinger may be omitted and the liner assembly may be floated into the wellbore. The isolation valve 132 may also be a check valve, such as a flapper valve, oriented to allow fluid flow from the wellbore 150 into the liner 100 and prevent fluid flow from the liner into the wellbore.

The centralizers 505*o* may be spaced along an outer surface of the liner 100. The centralizers 505*o* may engage an inner surface of the casing 101 and/or wellbore 150. The centralizers 505*o* may be flexible, such as being springs, in order to adjust to irregularities of the wellbore wall. The centralizers 505*o* may operate to center the liner 100 in the wellbore 150. The liner hanger 108, 109 may be as discussed above. Alternatively, an extendable liner hanger, such as slips and cone, may be used instead of the expandable liner hanger.

The workstring 120 may include a string of tubulars, such as drill pipe, longitudinally and rotationally coupled by threaded connections. The setting tool may include one or more centralizers 505*i*, a latch 140, a seal 125, one or more wiper plugs 510*t,b*, an expander 160, and an anchor 170. The setting tool may be longitudinally connected to the workstring, such as by a threaded connection. Members of the setting tool may each be longitudinally connected to one another, such as by a threaded connection. The expander 160 may be operable to radially and plastically expand the liner hanger 108, 109 into engagement with the casing string 101 (or another liner string) previously installed in the wellbore 150.

The centralizers 505*i* may be spaced along the setting tool, and may serve to center the setting tool within the liner 100. The seal 125 may engage an inner surface of the liner 100 and may be pressure operated, such as a cup seal or chevron seal stack. The seal 125 may also include a piston body. The latch 140 may be disposed above the seal 125 (as shown) or below the seal. The latch 140 may include slips or jaws radially extendable to engage an inner surface of the liner. Alternatively, the latch 140 may include dogs or a collet radially extendable to engage a profile formed in an inner surface of the liner. The anchor 170 may include slips or jaws radially extendable to engage an inner surface of the casing 101.

Figure 11B:
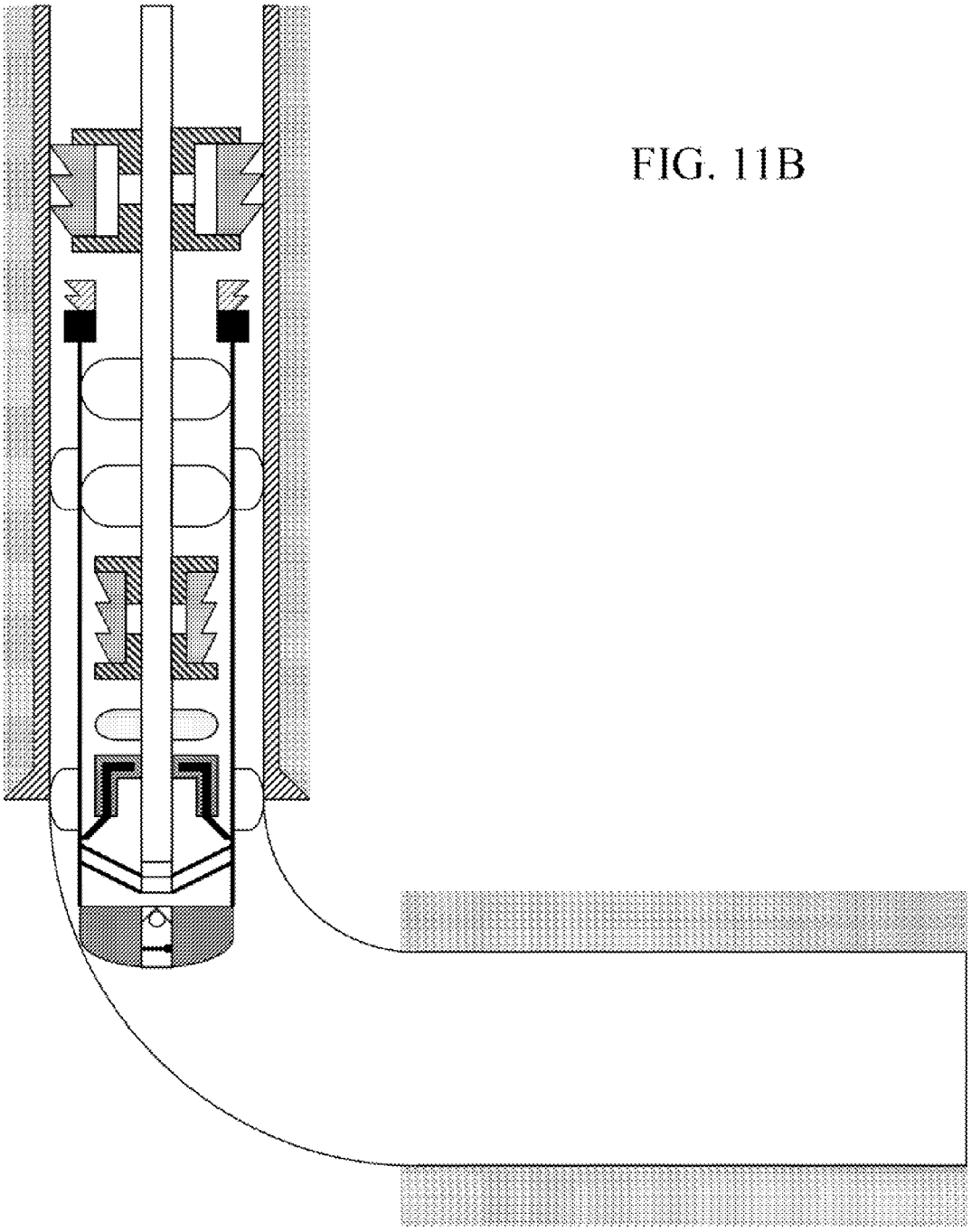

FIG. 11B illustrates release of the latch 140 and setting of the anchor 170. Once deployed, the latch 140 may be released by increasing pressure in the workstring to a first threshold pressure. Alternatively, the latch may be released by articulation of the workstring 120, such as by rotation, pulling up, or setting down. After release of the latch, the workstring 120 may be raised to release the float valve 131 from the stinger. Once released, the pressure in the workstring may be increased to a second threshold pressure greater or substantially greater than the first threshold pressure, thereby setting the anchor 170. Alternatively, the latch may be released and the anchor may be set at the same threshold pressure.

Figure 11C:
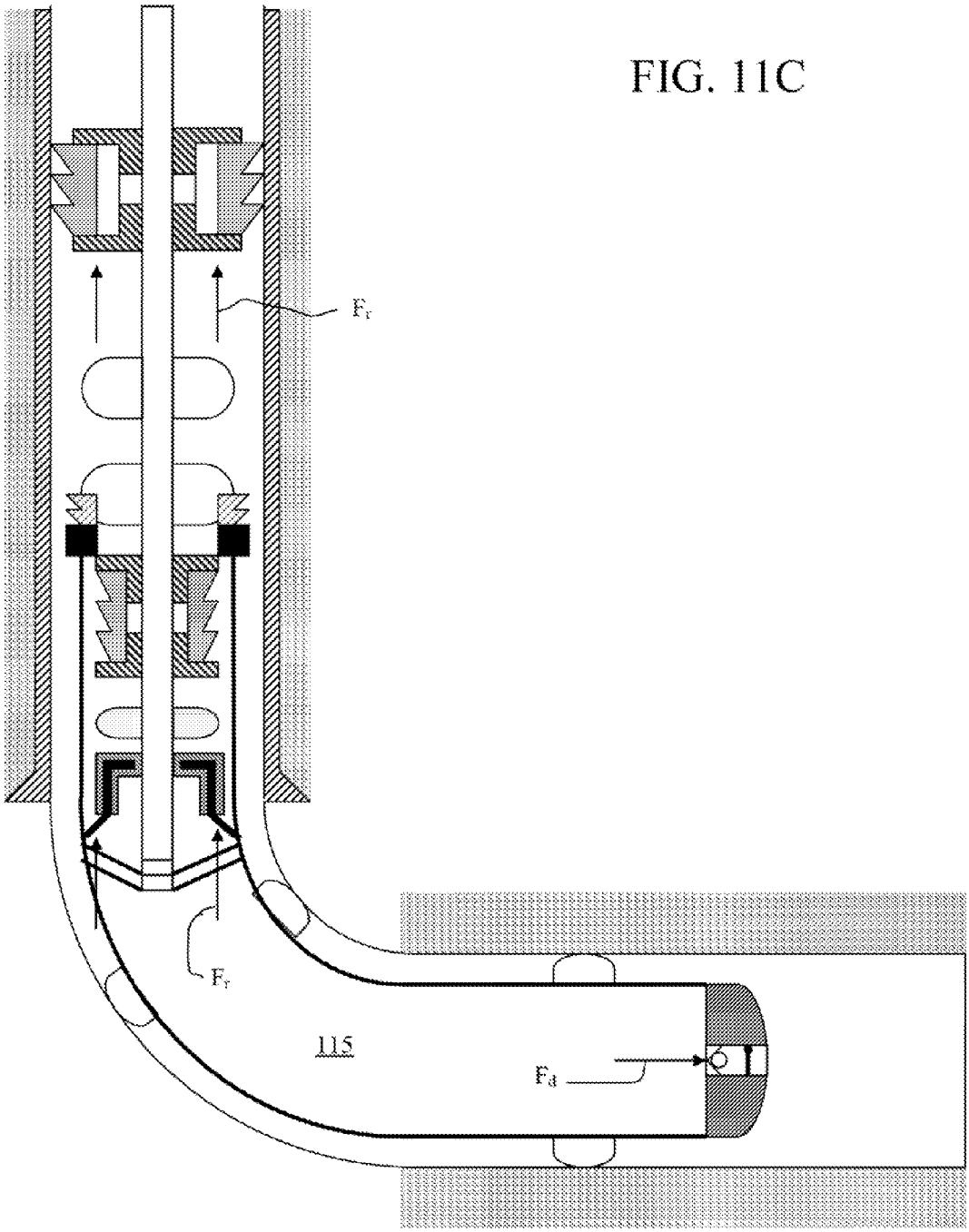

FIG. 11C illustrates driving the liner into a deviated, such as horizontal, section of the wellbore 150. Once the anchor 170 has been set, hydraulic fluid, such as drilling mud, may be pumped through the workstring 120 into a chamber 115 formed by the seal, the liner, the shoe, and the isolation valve. The fluid may exert a hydraulic force $F_d$ driving the liner assembly into the deviated portion of the wellbore 150. The driving pressure may be greater or substantially greater than the second threshold pressure. However, the hydraulic fluid may also exert a reactionary force $F_r$ on the setting tool and workstring 120. If not for the anchor 170, the forces F would be limited to a buckling strength and/or weight of the workstring (including the setting tool). Advantageously, the anchor 170 may divert the reaction force $F_r$ from the setting tool to the casing 101 instead of to the workstring, thereby increasing the force available to drive the liner assembly into the wellbore.

Figure 11D:
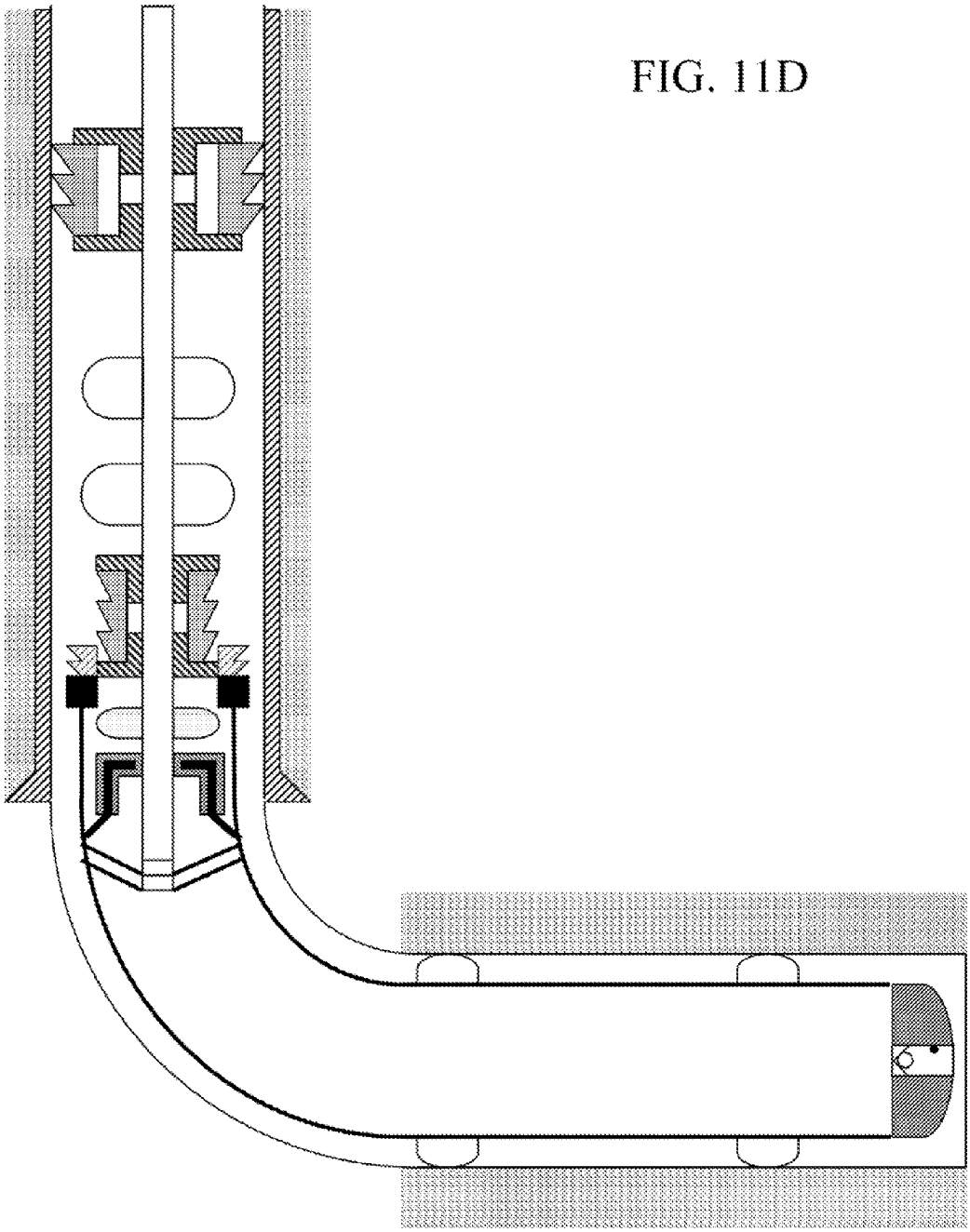

FIG. 11D illustrates rupture of the isolation valve 132. The isolation valve 132 may include a frangible or fluidly displaceable valve member or seat, such that the valve may be permanently opened at a third threshold pressure greater or substantially greater than the driving pressure. The isolation valve flapper may include a rupture disk operable to rupture at the third threshold pressure. Once the liner assembly has been driven into the deviated wellbore section, the pressure may be increased to the third threshold pressure, thereby fracturing the rupture disk and allowing fluid flow from the liner 100 to the wellbore 150. Alternatively, a rupture disk may be used instead of the isolation valve.

Figure 11E:
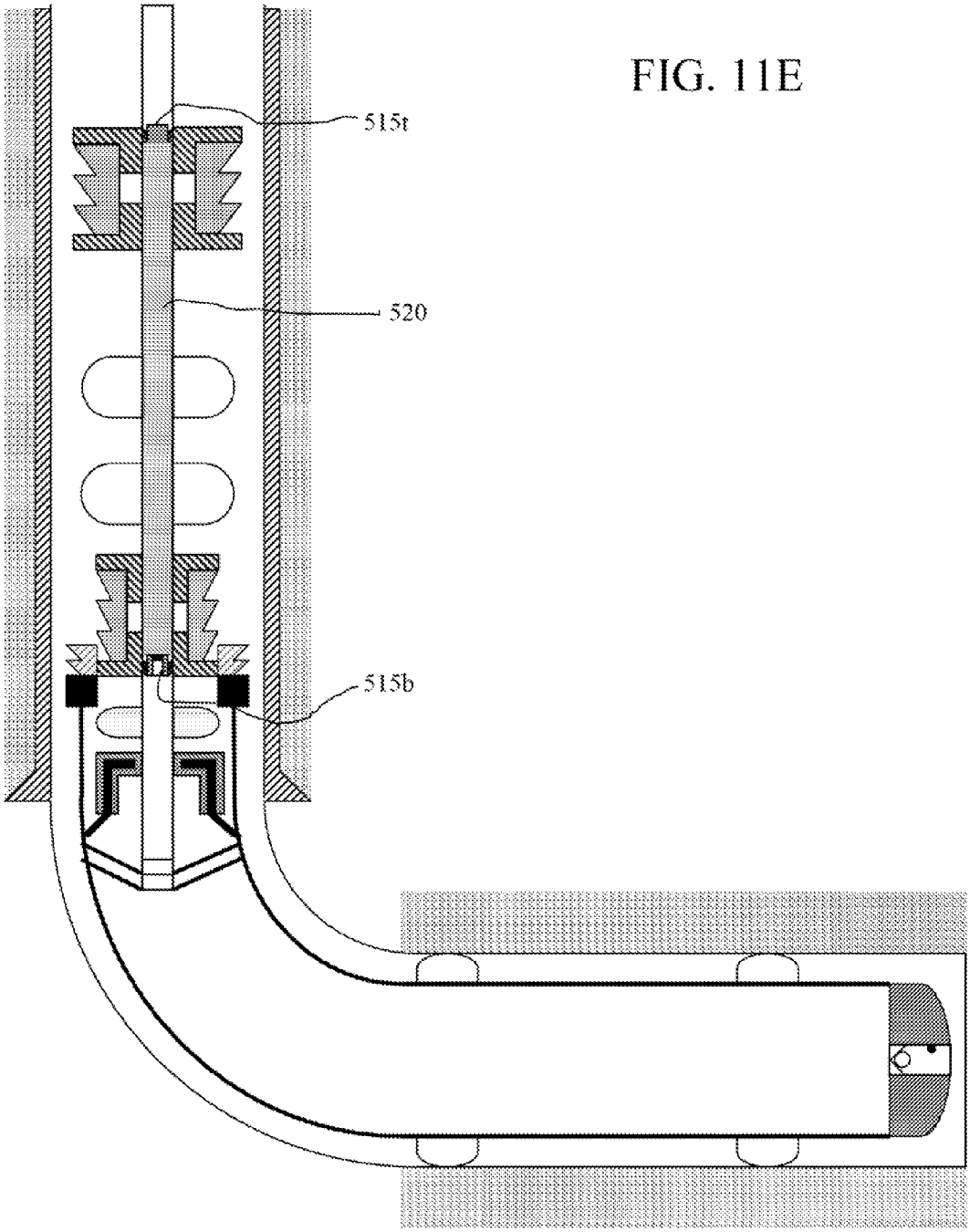

FIG. 11E illustrates pumping cement through the setting tool. Prior to deployment of the liner assembly, fluid, such as drilling mud, may be circulated to ensure that all of the cuttings have been removed from the wellbore 150. After fracture of the isolation valve, circulation may then be re-established by pumping fluid, such as drilling mud, down the workstring and up the liner annulus. A bottom dart 515*b* may be launched. Cement slurry 520 may then be pumped from the surface into the workstring 120. A spacer fluid (not shown) may be pumped in ahead of the cement 520. Once a predetermined quantity of cement 520 has been pumped, a top dart 515*t* may be pumped down the workstring 120 using a displacement fluid, such as drilling mud 310.

Figure 11F:
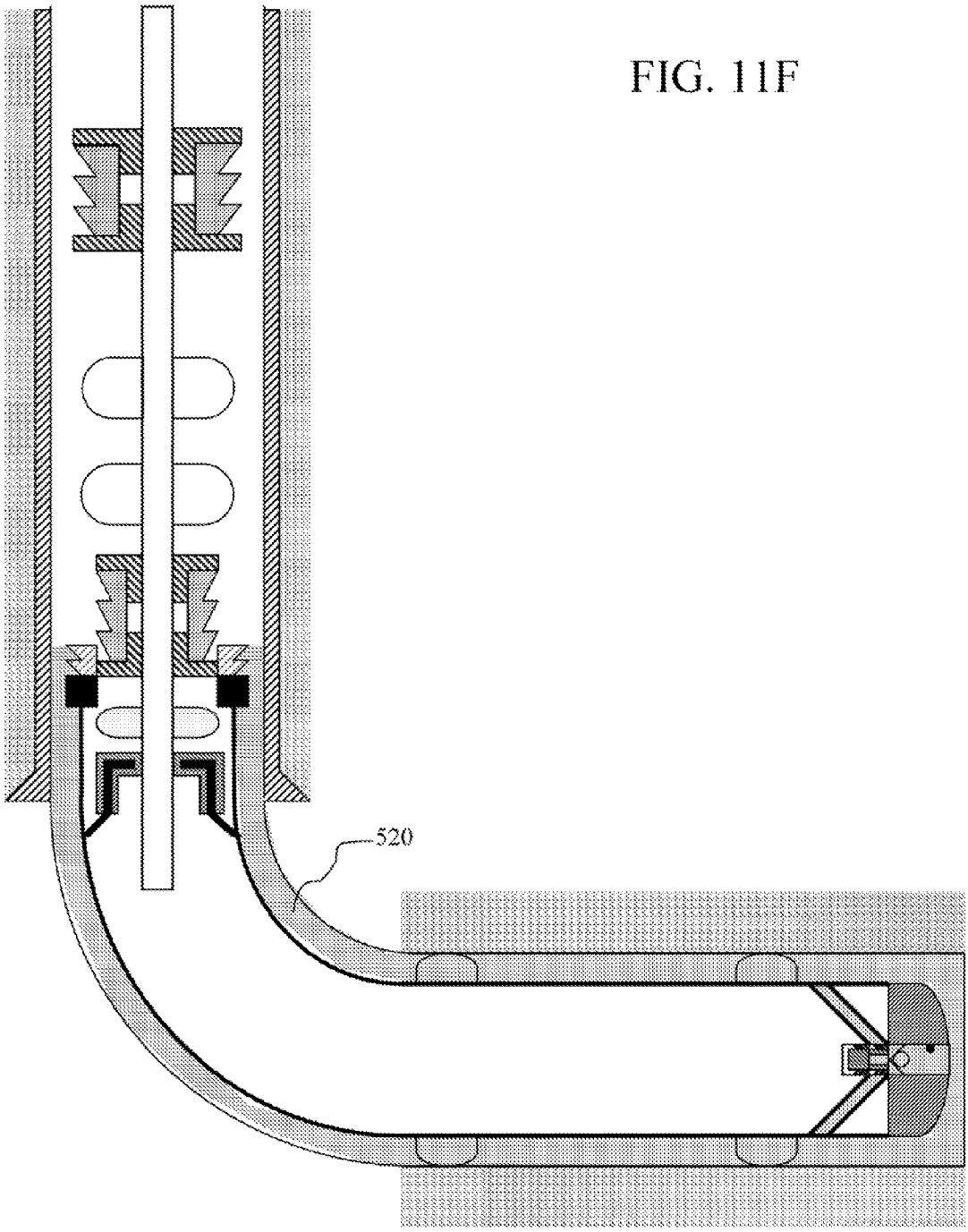

FIG. 11F illustrates the liner assembly cemented to the wellbore 150. The bottom dart 515*b* may seat in the bottom wiper plug 510*b*, release the bottom dart/plug from the setting tool, and land in the shoe 130. Alternatively, the liner assembly may include a float collar, the float valve may be located in the float collar, and the bottom dart/plug may land in the float collar. A diaphragm or valve in the bottom dart 515*b* may then rupture/open due to a density differential between the cement and the circulation fluid and/or increased pressure from the surface.

Pumping of the displacement fluid may continue and the top dart 515*t* may seat in the top wiper plug 510*t*, thereby closing the bore therethrough and releasing the top wiper plug 510*t* from the setting tool. The top dart/plug may then be pumped down the liner 100, thereby forcing the cement 315 through the liner and out into the liner annulus. Pumping may continue until the top dart/plug seat against the bottom dart/plug, thereby indicating that the cement 315 is in place in the liner annulus.

Figure 11G:
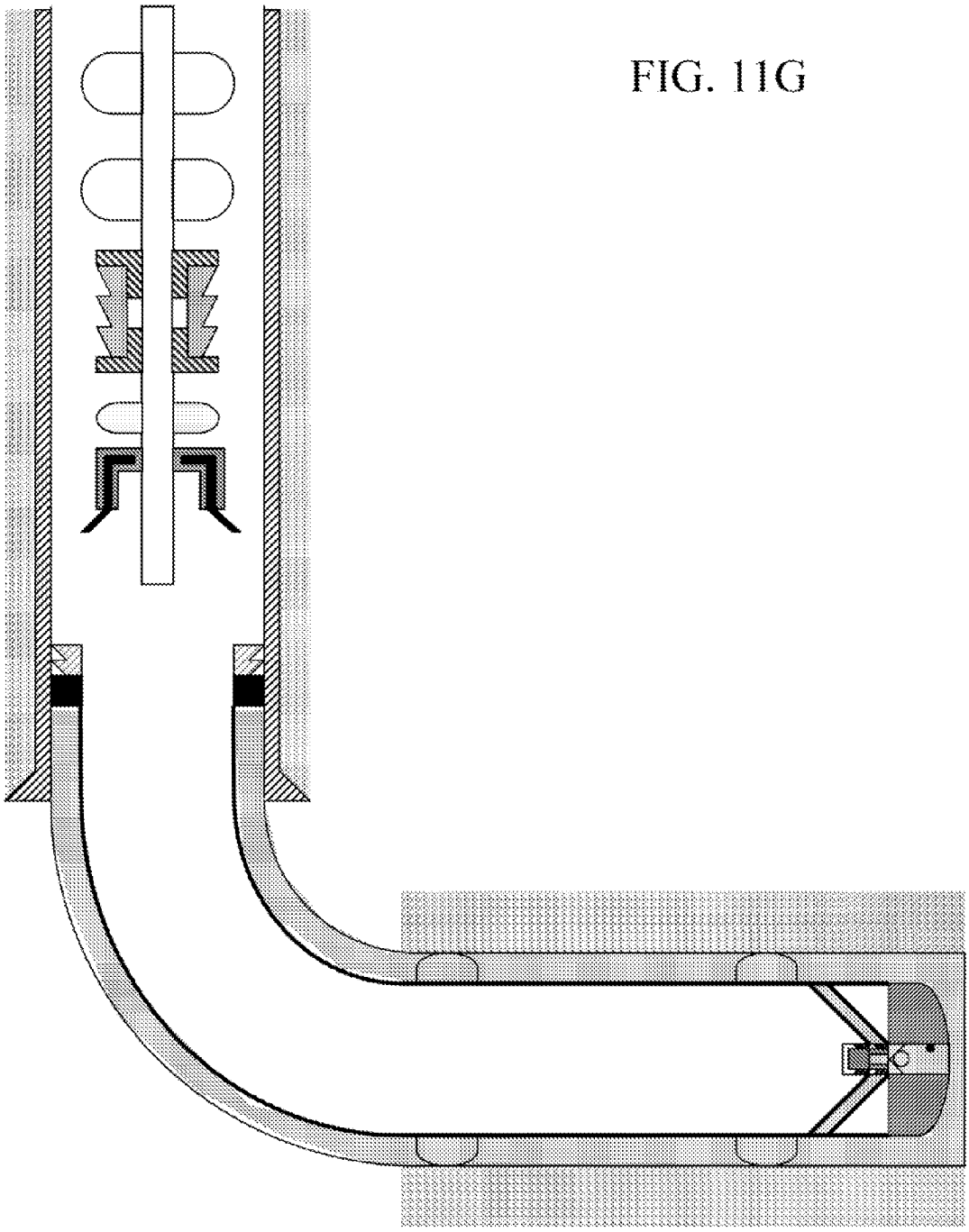

FIG. 11G illustrates the liner hanger 108, 109 expanded into engagement with the casing 101 and the setting tool being retrieved to surface. Once the cement 520 is in place in the liner annulus, the setting tool may be raised, thereby engaging the expander with the liner hanger 108, 109 and expanding the liner hanger into engagement with the casing 101. Once the hanger 108, 109 is expanded into engagement with the casing 101 (or liner), the setting tool may be retrieved to the surface. Before retrieval to the surface, the setting tool may be raised and fluid, such as drilling mud, may be reverse circulated (not shown) to remove excess cement above the hanger before the cement cures. Once the cement cures, the wellbore may be completed, such as perforating the liner and installing production tubing to the surface, and the hydrocarbon-bearing formation may be produced.

Alternatively or additionally, one or more jack pistons 200 may be used to drive the liner 100 into the wellbore 150. Alternatively, the telescoping liner 400 may be used instead of the liner 100. Alternatively or additionally any of the alternatives discussed above for the embodiments relating to FIGS. 1-10 may be used with the embodiment of FIG. 11.

While the foregoing is directed to embodiments of the present invention, other and further embodiments of the invention may be devised without departing from the basic scope thereof, and the scope thereof is determined by the claims that follow.

I claim:

1. A method of lining a wellbore with a liner, comprising:

deploying the liner into the wellbore using a workstring and a setting tool;

engaging the setting tool with a previously installed casing or a previously installed liner in the wellbore; and pressurizing a chamber formed between a seal of the setting tool and a shoe of the liner, thereby driving the liner further into the wellbore, wherein reactionary force is transferred to the previously installed casing or liner by the engaged setting tool.

2. The method of claim 1, wherein the liner is deployed until progress is impeded by frictional resistance of the wellbore.

3. The method of claim 1, further comprising cementing the liner into the wellbore.

4. The method of claim 1, further comprising expanding a liner hanger connected to the liner into engagement with the previously installed casing or the previously installed liner.

5. The method of claim 1, further comprising:

depressurizing the chamber;

moving the workstring down the liner; and re-pressurizing the chamber, thereby advancing the liner further into the wellbore.

6. The method of claim 5, wherein pressurizing the chamber also engages a piston with an inner surface of the liner and the piston also drives the liner.

7. The method of claim 1, further comprising expanding a screen portion of the liner into engagement with the wellbore.

8. A method of running a liner into a wellbore, comprising:

securing an inner string to the liner, wherein the inner string comprises a seal operable to engage an interior of the liner;

running the liner into the wellbore using the inner string;

releasing the liner from the inner string;

closing a valve disposed in a shoe of the liner; and pressurizing an internal area between the seal and the valve, thereby advancing the liner further into the wellbore.

9. The method of claim 8, wherein the liner is run-in until progress is impeded by frictional resistance of the wellbore.

10. The method of claim 8, wherein pressurizing the internal area advances the liner by exerting a pushing force against the shoe.

11. The method of claim 8, wherein pressurizing the internal area advances the liner by actuating a jack to engage an interior of the liner and operating a piston to advance the liner further into the wellbore.

12. The method of claim 8, further comprising expanding an upper portion of the liner into engagement with a casing.

13. The method of claim 8, further comprising cementing the liner into the wellbore.

14. The method of claim 8, further comprising:

depressurizing the internal area;

moving the inner string down the liner; and re-pressurizing the internal area, thereby advancing the liner further into the wellbore.

15. The method of claim 8, wherein:

the liner comprises an expandable screen, and the method further comprises expanding the expandable screen.

16. The method of claim 8, further comprising engaging the inner string with a previously installed casing or a previously installed liner in the wellbore, wherein reactionary force is transferred to the previously installed casing or previously installed liner by the engaged inner string.

17. The method of claim 8, further comprising expanding a liner hanger connected to the liner into engagement with a previously installed casing or a previously installed liner.

* * * * *